US009865915B2

(12) United States Patent
Shiu et al.

(10) Patent No.: US 9,865,915 B2
(45) Date of Patent: Jan. 9, 2018

(54) ELECTRONIC DEVICE WITH DIVERSE ANTENNA ARRAY HAVING SOLDERED CONNECTIONS

(71) Applicant: Apple Inc., Cupertino, CA (US)

(72) Inventors: Boon W. Shiu, San Jose, CA (US); Jerzy Guterman, Mountain View, CA (US); Mattia Pascolini, San Mateo, CA (US)

(73) Assignee: Apple Inc., Cupertino, CA (US)

( * ) Notice: Subject to any disclaimer, the term of this patent is extended or adjusted under 35 U.S.C. 154(b) by 1171 days.

(21) Appl. No.: 13/780,787

(22) Filed: Feb. 28, 2013

(65) Prior Publication Data

US 2014/0240195 A1 Aug. 28, 2014

(51) Int. Cl.
*H01Q 1/24* (2006.01)
*H01Q 9/42* (2006.01)
*H01Q 21/28* (2006.01)

(52) U.S. Cl.
CPC ..... *H01Q 1/24* (2013.01); *H01Q 9/42* (2013.01); *H01Q 21/28* (2013.01)

(58) Field of Classification Search
CPC ..... H01Q 21/28
See application file for complete search history.

(56) References Cited

U.S. PATENT DOCUMENTS 6,140,972 A * 10/2000 Johnston ..... H01Q 19/106 343/725
7,385,560 B1 * 6/2008 Maloratsky ..... H01Q 1/28 343/705
7,999,753 B2 8/2011 Gaucher et al.
8,436,783 B2 5/2013 Eisten
2011/0294537 A1 * 12/2011 Vance ..... H01Q 9/0421 455/550.1
2012/0068893 A1 3/2012 Guterman et al.
2012/0287005 A1 * 11/2012 Pintos ..... H01Q 19/06 343/754
2012/0326943 A1 12/2012 Flores-Caudras et al.
2013/0050032 A1 2/2013 Shiu et al.
2013/0082895 A1 4/2013 Shiu et al.
2014/0043190 A1 * 2/2014 Vummidi Murali ..... H01Q 1/38 343/700 MS

FOREIGN PATENT DOCUMENTS

WO 2009127268 10/2009

* cited by examiner

*Primary Examiner* — Graham Smith
(74) *Attorney, Agent, or Firm* — Treyz Law Group, P.C.; G. Victor Treyz; Michael H. Lyons

(57) ABSTRACT

A wireless electronic device may be provided with antenna structures. The antenna structures may be formed from an antenna ground and an array of antenna resonating elements. The antenna resonating elements may be electrically connected to the antenna ground using solder. The antenna resonating elements may be formed from metal traces on a dielectric support structure that surrounds the antenna ground. The antenna ground may be formed form stamped sheet metal and may have slanted steps adjacent to the antenna resonating elements. To form a solder joint between the metal antenna resonating element traces and the sheet metal of the antenna ground, laser light may be applied to the sheet metal of the antenna ground in the vicinity of the solder paste. Separate metal members may also be provided in the vicinity of the solder paste and may be heated using the laser to join metal traces on plastic carriers.

20 Claims, 11 Drawing Sheets

ELECTRONIC DEVICE WITH DIVERSE ANTENNA ARRAY HAVING SOLDERED CONNECTIONS

BACKGROUND

This relates to wireless electronic devices and, more particularly, to forming and using antenna arrays for wireless electronic devices.

Electronic devices such as computers, media players, cellular telephones, wireless base stations, and other electronic devices often contain wireless circuitry. For example, cellular telephone transceiver circuitry or wireless local area network circuitry may be used to allow a device to wirelessly communicate with external equipment. Antenna structures in the wireless circuitry may be used in transmitting and receiving wireless signals.

It can be challenging to incorporate wireless circuitry such as antenna structures into an electronic device. Space is often at a premium, particularly in compact devices. There may be a desire to incorporate more than one antenna into a device, but care must be taken to ensure that the antennas do not interfere with each other and to ensure that antenna structures can be manufactured in satisfactory volumes during production of the electronic device.

It would therefore be desirable to be able to provide improved electronic device antenna structures.

SUMMARY

An electronic device may contain storage and processing circuitry and input-output circuitry such as wireless communications circuitry. The wireless circuitry may include a radio-frequency transceiver coupled to antenna structures. The radio-frequency transceiver circuitry may support communications in communications bands such as cellular telephone communications bands and wireless local area network bands.

The antenna structures may be formed from an antenna ground and an array of antenna resonating elements that share the antenna ground. There may be, for example, six antenna resonating elements for forming an array of six respective antennas around the periphery of the antenna ground. The electric field polarizations of at least some of the antennas may be different. Providing the antenna array with polarization diversity may enhance antenna performance.

The antenna resonating elements may be formed from metal traces on a dielectric support structure that surrounds the antenna ground. The antenna ground may be formed form stamped sheet metal and may have slanted steps adjacent to the antenna resonating elements.

The antenna resonating elements may be electrically connected to the antenna ground using solder. To form a solder joint between the metal antenna resonating element traces and the sheet metal of the antenna ground, laser light may be applied to the sheet metal of the antenna ground in the vicinity of the solder paste. When joining metal traces on a pair of respective plastic carriers, a separate metal member may be provided in the vicinity of the solder paste. The solder paste in this type of joint may be heated by applying laser light to the metal member.

Further features of the invention, its nature and various advantages will be more apparent from the accompanying drawings and the following detailed description of the preferred embodiments.

DETAILED DESCRIPTION

Figure 1:
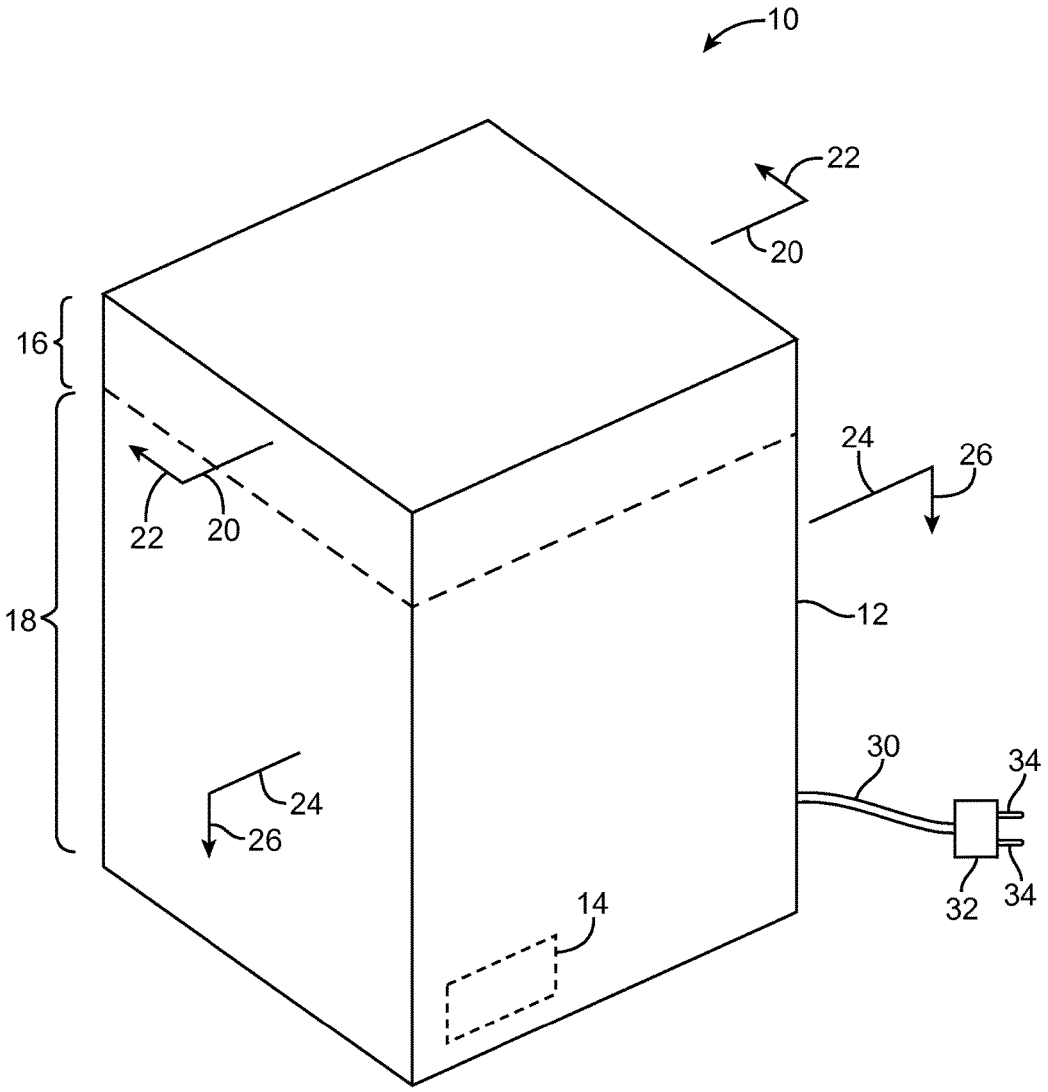
FIG. 1 is a perspective view of an illustrative electronic device containing wireless circuitry in accordance with an embodiment of the present invention.

Wireless electronic devices such as wireless electronic device 10 of FIG. 1 may contain wireless circuitry. The wireless circuitry of wireless electronic device 10 may include radio-frequency transceiver circuitry and associated antenna structures for transmitting and receiving wireless signals. Electronic device 10 may be a handheld electronic device such as a portable media player or cellular telephone, may be a portable computer such as a tablet computer or laptop computer, may be a desktop computer, may be a television, may be a wireless access point or other wireless base station, may be a computer monitor, may be a set-top box, may be a gaming console, or may be other electronic equipment. Illustrative configurations in which wireless electronic device 10 is a wireless base station such as a wireless base station that serves as a wireless access point for a wireless local area network and that may be provided with a hard drive or other mass storage device are sometimes described herein as an example.

As shown in FIG. 1, electronic device 10 may have a housing such as housing 12. Housing 12 may be formed from one or more housing structures. Housing 12 may include metal structures, plastic structures, glass structures, ceramic structures, and structures formed from other materials. Housing 12 may, if desired, be formed using a unibody construction in which housing 12 or substantially all of housing 12 is formed from a single machined piece of material. Housing 12 may also be formed by joining two or more parts (e.g., first and second housing members, internal housing frame structures, etc.). To allow antennas to operate satisfactorily, the walls of housing 12 may be formed from a dielectric such as plastic or one or more dielectric antenna window structures may be formed in a conductive housing 12. As an example, the top and four sides of housing 12 may be formed form plastic.

Device 10 may include antenna structures and additional electrical components. The antenna structures may be located in an upper portion of housing 12 such as upper portion 16. The antenna structures may include one or more antennas that are used to wirelessly transmit and receive signals for device 10. Antenna structures in device 10 may, for example, include multiple antennas organized to form a multiple antenna array. The antenna array may be used for implementing wireless communications schemes such as MIMO (multiple input multiple output) schemes.

The additional electrical components may be located in a lower portion of housing 12 such as lower portion 18. Device 10 may be coupled to a source of alternating current line power or a source of direct current power. For example, device 10 may receive alternating current power through electrical cord 20 and plug 32. Plug 32 may have prongs 34 that fit into a wall outlet.

Device 10 may include data ports, buttons, and other components. Such components may be mounted in a region of device 10 such as region 14 of FIG. 1. Buttons may be used for turning on and off device 10, for making settings adjustments when using device 10, and for otherwise facilitating user interactions with device 10. Openings may be formed in the housing wall of device 10 in region 14 of housing 12 or other suitable region to accommodate ports such as audio jacks, digital data ports, etc. Status indicator lights and other input-output devices may also be incorporated in device 10 in a region such as region 14, if desired.

Figure 2:
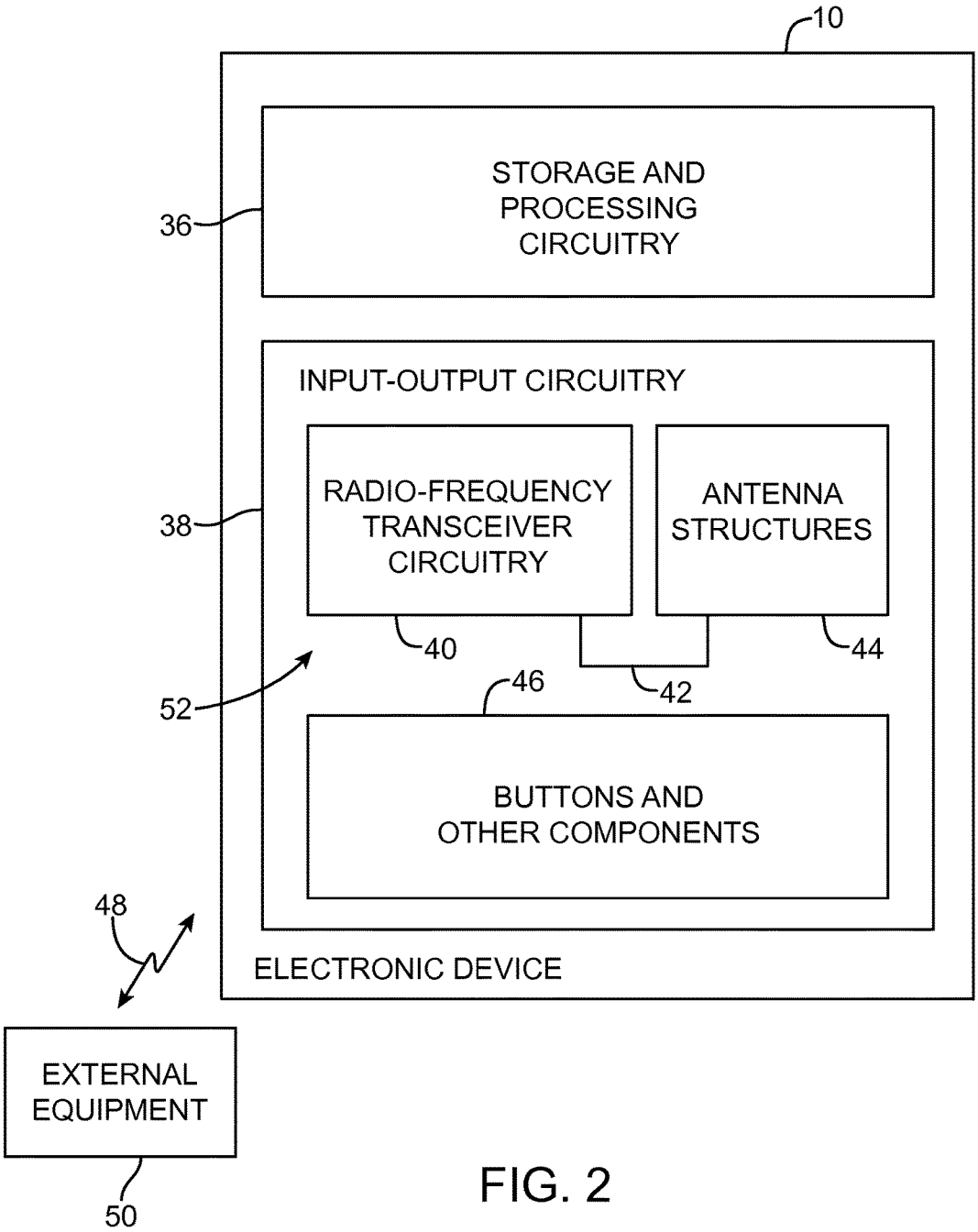
FIG. 2 is a schematic diagram of an illustrative electronic device containing wireless circuitry and associated external equipment that may wirelessly communicate with the electronic device over a wireless communications path in accordance with an embodiment of the present invention.

FIG. 2 is a schematic diagram showing illustrative components that may be included in an electronic device such as electronic device 10 of FIG. 1. As shown in FIG. 2, electronic device 10 may include control circuitry such as storage and processing circuitry 36 and may include associated input-output circuitry 38.

Control circuitry 36 may include storage and processing circuitry that is configured to execute software that controls the operation of device 10. Control circuitry 36 may include microprocessor circuitry, digital signal processor circuitry, microcontroller circuitry, application-specific integrated circuits, and other processing circuitry. Control circuitry 36 may also include storage such as volatile and non-volatile memory, hard-disk storage, removable storage, solid state drives, random-access memory, memory that is formed as part of other integrated circuits such as memory in a processing circuit, etc.

Input-output circuitry 38 may include components for receiving input from external equipment and for supplying output. For example, input-output circuitry 38 may include user interface components for providing a user of device 10 with output and for gathering input from a user. As shown in FIG. 2, input-output circuitry 38 may include wireless circuitry 52. Wireless circuitry 52 may be used for transmitting and/or receiving signals in one or more communications bands such as cellular telephone bands, wireless local area network bands (e.g., the 2.4 GHz and 5 GHz IEEE 802.11 bands), satellite navigation system bands, etc. For example, when device 10 is used as a wireless base station, wireless circuitry 52 may support 2.4 GHz and 5 GHz IEEE 802.11 wireless local area network communications.

Wireless circuitry 52 may include transceiver circuitry such as radio-frequency transceiver 40. Radio-frequency transceiver 40 may include a radio-frequency receiver and/or a radio-frequency transmitter. Radio-frequency transceiver circuitry 40 may be used to handle wireless signals in communications bands such as the 2.4 GHz and 5 GHz WiFi® bands, cellular telephone bands, and other wireless communications frequencies of interest.

Radio-frequency transceiver circuitry 40 may be coupled to one or more antennas in antenna structures 44 using transmission line structures such as transmission lines 42. Transmission lines 42 may include coaxial cables, microstrip transmission lines, transmission lines formed from traces on flexible printed circuits (e.g., printed circuits formed from flexible sheets of polyimide or other layers of flexible polymer), transmission lines formed from traces on rigid printed circuit boards (e.g., fiberglass-filled epoxy substrates such as FR4 boards), or other transmission line structures. If desired, circuitry may be interposed within transmission line structures 42 such as impedance matching circuitry, filter circuitry, switches, and other circuits. This circuitry may be implemented using one or more components such as integrated circuits, discrete components (e.g., capacitors, inductors, and resistors), surface mount technology (SMT) components, or other electrical components.

Antenna structures 44 may include inverted-F antennas, patch antennas, loop antennas, monopoles, dipoles, or other suitable antennas. Configurations in which at least one antenna in device 10 is formed from an inverted-F antenna structure are sometimes described herein as an example. Wireless circuitry 52 may use antenna structures 44 to transmit and receive wireless signals such as wireless signals 48, thereby allowing device 10 to communicate with external equipment 50. External equipment 50 may be a handheld electronic device such as a portable media player or cellular telephone, may be a portable computer such as a tablet computer or laptop computer, may be a desktop computer, may be a television, may be a wireless access point or other wireless base station, may be a computer monitor, may be a set-top box, may be a gaming console, or may be other electronic equipment. For example, if electronic device 10 has been configured to serve as a wireless base station, external equipment 50 may be one or more tablet computers, cellular telephones, portable computers, desktop computers, media player equipment, and other equipment that communicates with the wireless base station using wireless signals 48.

Input-output circuitry 38 may include buttons and other components 46. Components 46 may include buttons such as sliding switches, push buttons, menu buttons, buttons based on dome switches, keys on a keypad or keyboard, or other switch-based structures. Components 46 may also include sensors, displays, speakers, microphones, cameras, status indicators lights, etc.

Figure 3:
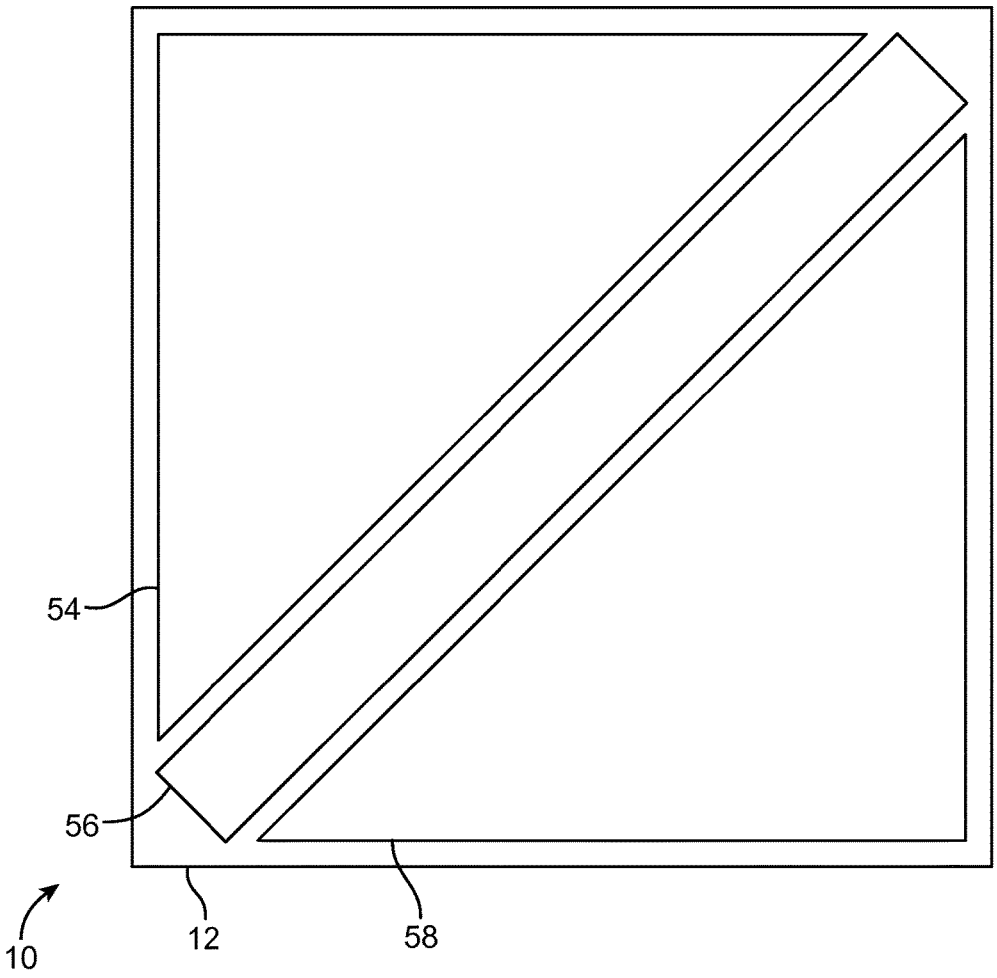
FIG. 3 is a cross-sectional top view of an illustrative electronic device of the type shown in FIG. 1 in accordance with an embodiment of the present invention.

A cross-sectional top view of device 10 of FIG. 1 taken along line 24 and viewed in direction 26 of FIG. 1 is shown in FIG. 3. As shown in FIG. 3, housing 12 may have a rectangular outline. Storage such as a hard drive, a solid state drive, or other mass storage device may be mounted within diagonal region 56. The mass storage device may be used to store large amounts of data (e.g., more than 256 GB, more than 1 TB, etc.). Region 58 may contain power supply circuitry, a fan, control circuitry 36 and input-output circuitry 38 of FIG. 2, and other electrical components. Region 54 may contain a heat sink. For example, metal heat sink fins that are used in cooling the hard drive or other storage of region 56 and/or the circuitry of region 58 may be installed in region 54.

Figure 4:
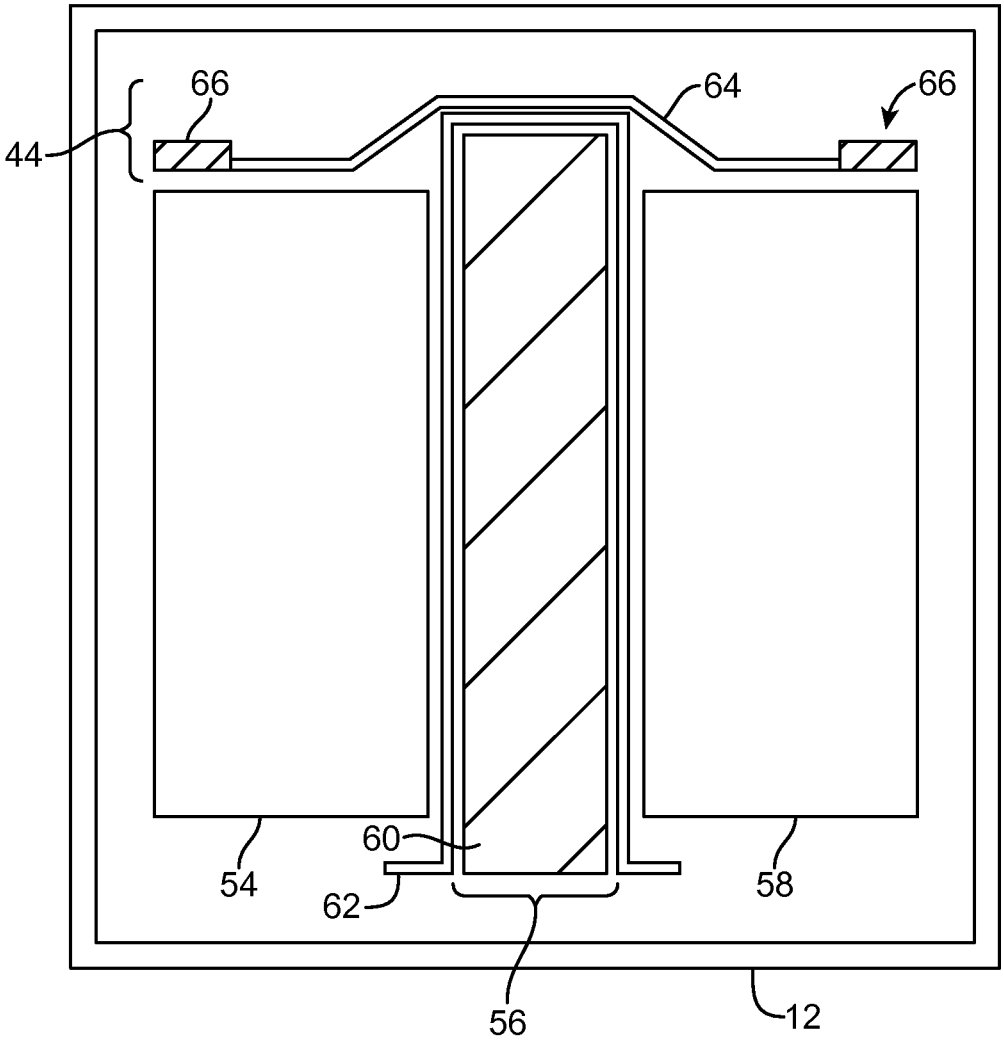
FIG. 4 is a cross-sectional side view of an illustrative electronic device of the type shown in FIG. 1 in accordance with an embodiment of the present invention.

A cross-sectional side view of device 10 of FIG. 1 taken along line 20 of FIG. 1 and viewed in direction 22 is shown in FIG. 4. As shown in FIG. 4, the components of device 10 may be mounted within the interior of device housing 12. Hard disk drive 60 or other storage components may, if desired, be mounted within bracket 62 in region 56. Antenna structures 44 may include antenna ground structure 64 and antenna resonating elements 66. Bracket 62 may be a metal bracket. Antenna ground structures 54 may be formed from a stamped sheet metal part that is mounted to metal bracket 62. Antenna ground structures 54 may be grounded to a source of ground potential by virtue of being electrically shorted to metal bracket 62, which may be grounded.

Antennas in an antenna array for device 10 may be formed by mounting antenna resonating elements 66 within the vicinity of antenna ground structures 64. Antenna ground structures 64 may sometimes be referred to as an antenna can or grounding can or may be referred to as a shared antenna ground in scenarios such as those in which structures 64 form a common ground for each of antenna resonating elements 66. Portions of antenna resonating elements 66 may be shorted to antenna ground structures 64 using solder or other electrical paths.

Antenna resonating elements 66 may be based on patch antenna resonating elements, loop antenna resonating elements, monopole antenna resonating elements, dipole antenna resonating elements, planar inverted-F antenna resonating elements, slot antenna resonating elements, other antenna resonating elements, or combinations of these antenna resonating elements. As an example, antenna resonating elements 66 may be inverted-F antenna resonating elements that are used in forming an array of inverted-F antennas for device 10.

Figure 5:
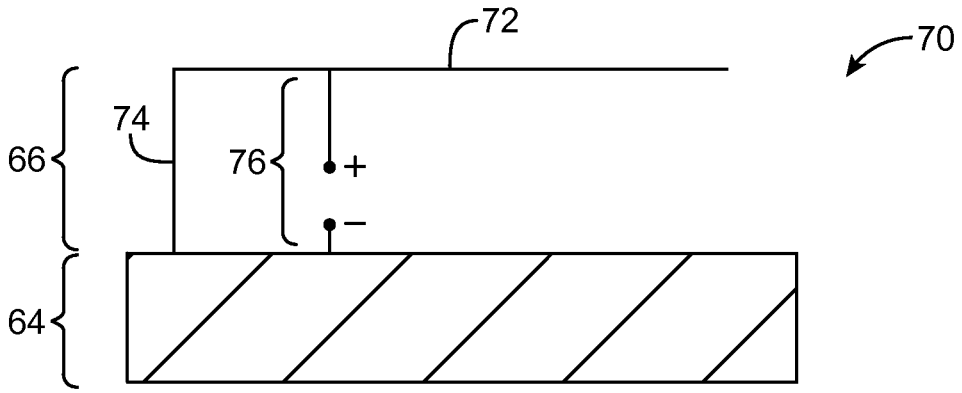
FIG. 5 is a diagram of an illustrative antenna of the type that may be used in forming an antenna array with multiple antennas in a wireless electronic device in accordance with an embodiment of the present invention.

FIG. 5 is a diagram of an illustrative inverted-F antenna 70 formed from inverted-F antenna resonating element 66 and antenna ground 64. Antenna ground 64 may be a stamped metal ground structure such as antenna ground 64 of FIG. 4. Antenna resonating element 66 may be a single arm or multi-arm inverted-F antenna resonating element that is mounted adjacent to antenna ground structures 64 as shown in FIG. 4.

As shown in FIG. 5, antenna resonating element 66 may have a main resonating element arm such as arm 72. Short circuit branch 74 may be coupled between arm 72 and ground 64. Antenna feed branch 76 may be coupled between arm 72 and ground 64 in parallel with short circuit branch 74. Antenna feed branch 76 may form an antenna feed that includes a positive antenna feed terminal (+) and a ground antenna feed terminal (−). A positive transmission line conductor in transmission line structures 42 may be coupled between a positive terminal in radio-frequency transceiver circuitry 40 and positive antenna feed terminal (+). A ground transmission line conductor in transmission line structures 42 may be coupled between a ground terminal in radio-frequency transceiver circuitry 40 and ground antenna feed terminal (−).

Resonating element arm 72 may have a single branch or may have a longer branch that is associated with a low band resonance and a shorter branch that is associated with a high band resonance (as an example). Configurations in which inverted-F antenna has three or more different resonating element branches may also be used. The single-arm configuration of antenna resonating element 66 of FIG. 5 is merely illustrative.

Figure 6:
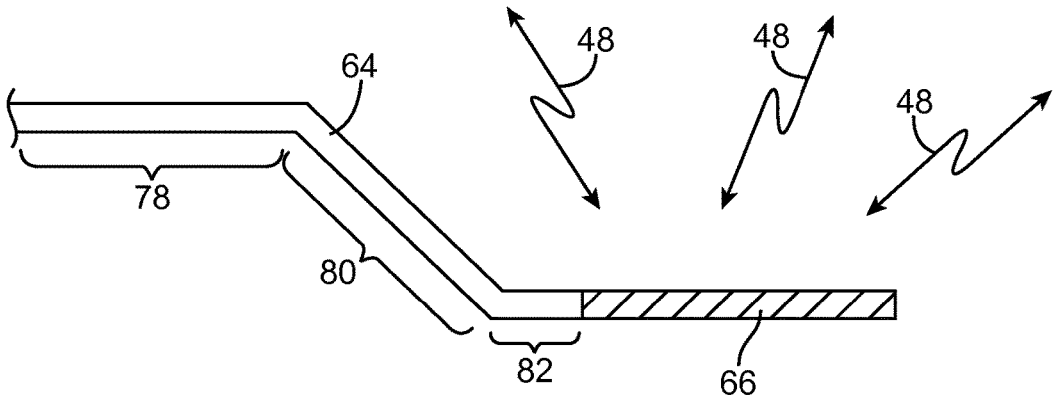
FIG. 6 is a cross-sectional side view of a portion of an antenna ground structure and an associated antenna resonating element being used to form an antenna in a wireless electronic device in accordance with an embodiment of the present invention.

Antenna ground structures 64 may be formed from a stamped sheet metal part that is oriented horizontally, as shown in FIG. 4. To help avoid undesired reflection-induced resonances in wireless performance and thereby improve antenna performance, it may be desirable to form at least some of the surfaces of antenna ground structures 64 with angles (i.e., with slanted surfaces that form diagonal steps between different ground plane regions). As shown in FIG. 6, for example, the sheet metal that is used in forming antenna ground structures 64 may be stamped to form planar horizontal portions such as horizontal portions 78 and 82 and angled portions such as angled portion 80. Angled surfaces 80 may help reduce the possibility of creating undesired standing wave reflections in the antennas of device 10 and may help evenly distribute the signals from the antennas of device 10, improving antenna performance while satisfying regulatory requirements for emitted signal levels.

As shown in FIG. 6, the surfaces of angled (slanted step) portion 80 may be oriented at a 45° angle with respect to horizontal surfaces such as surfaces 78 and 82. Angled surfaces in antenna ground structures 64 may be oriented at other angles (e.g., angles of more than 45° or less than 45°) with respect to horizontal surfaces such as surfaces 78 and 82, if desired. The configuration of FIG. 6 is merely illustrative.

Figure 7:
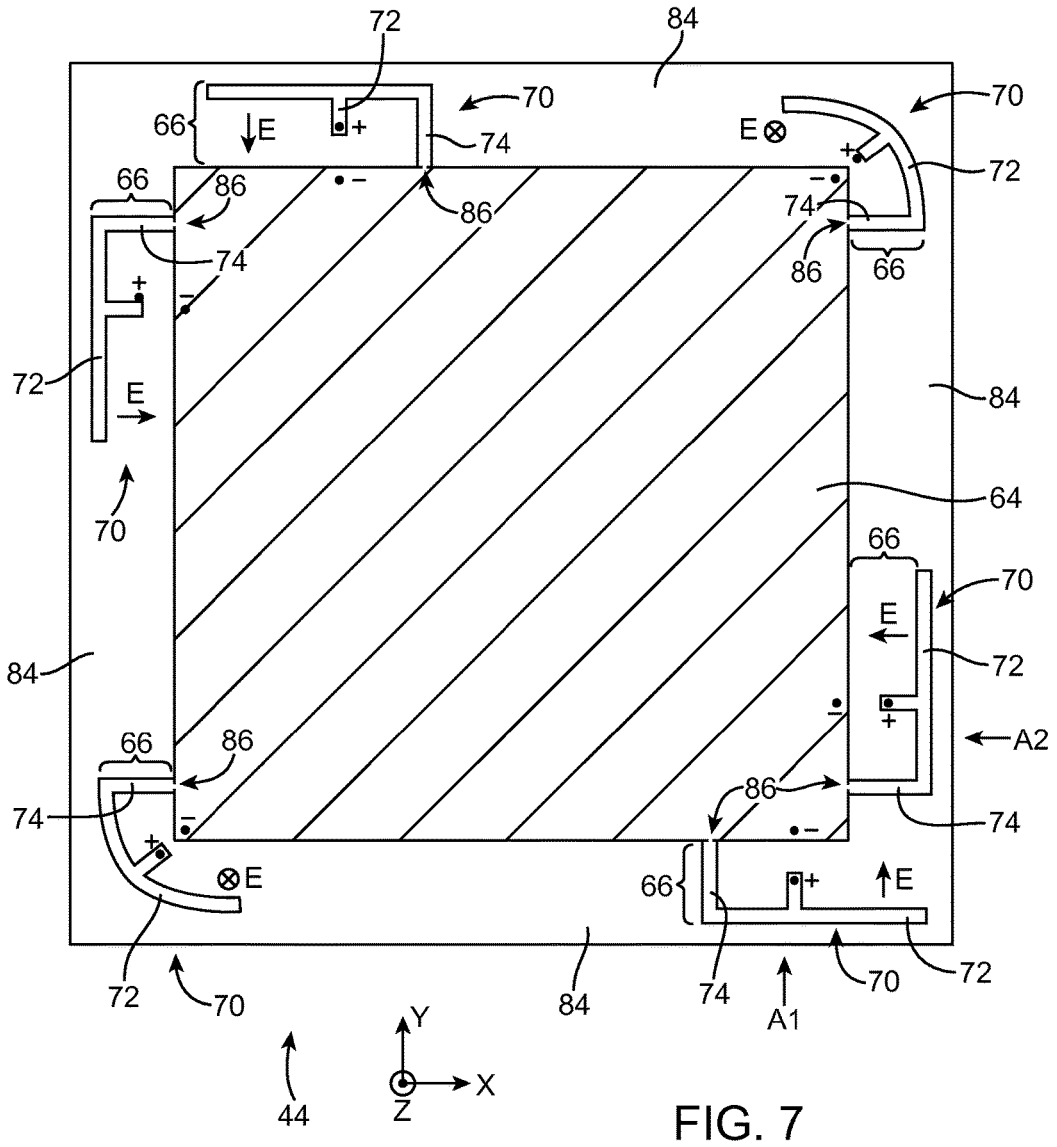
FIG. 7 is a top view of an antenna array formed from an antenna ground plane and an array of antenna resonating elements surrounding the ground plane in accordance with an embodiment of the present invention.

A top view of antenna structures 44 is shown in FIG. 7. As shown in FIG. 7, antenna structures 44 may include antenna ground structures 64 with an approximately footprint (e.g., a structure with a peripheral edge that outlines an approximately rectangular shape). Multiple antenna resonating elements 66 may be arranged around the periphery of antenna ground structures 64. There may be, for example, an array of six antennas 70 in antenna structures 44. In this type of configuration, three of the antennas may be configured to transmit and receive wireless signals in at least a 2.4 GHz wireless local area network communications band and another three of the antennas may be configured to transmit and receive wireless signals in at least a 5 GHz wireless local area network communications band.

In each antenna 70, short circuit branch 74 may be used to couple main resonating element arm 72 to antenna ground 64. Each antenna has an associated antenna feed formed from positive (+) and ground (−) antenna feed terminals. The positive and ground antenna feed terminals of each antenna feed may be coupled to transmission line structures 42 such as coaxial cables. For example, the antenna feed terminals of each antenna 70 of FIG. 7 may be coupled to a printed circuit board on which components for radio-frequency transceiver circuitry 40 have been mounted using a respective coaxial cable.

Because the inverted-F antenna resonating elements 66 are oriented in different directions in the configuration of FIG. 7, antennas 70 exhibit different polarizations, as indicated by the electric fields E associated with each antenna 70 in FIG. 7. Placement of antennas 70 within antenna structures 44 so that antennas 70 exhibit different polarizations helps improve wireless signal uniformity and reduces electromagnetic coupling between antennas 70, thereby improving performance of the antenna array (e.g., when handling MIMO signals). Electromagnetic coupling can also be reduced by ensuring that adjacent antennas such as antennas A1 and A2 operate in different bands.

The center of antenna structures 44 may be formed from a metal sheet with an approximately rectangular outline (i.e., antenna ground 64). Dielectric support structure 84 may surround the periphery of antenna ground 64. For example, dielectric support structures 84 may have the shape of a strip of dielectric material that runs along the edges of antenna ground 64, so that the strip of dielectric material forms a ring-shaped dielectric member. Adhesive, fasteners, solder, overmolding, engagement features, or other attachment mechanisms may be used in attaching dielectric support structures 84 to antenna ground structures 64. Because dielectric support structures 84 may be used in supporting antenna resonating elements 66 for antennas 70, dielectric support structures 84 are sometimes referred to as dielectric carriers, a dielectric support member, an antenna support structure, an antenna support, or an antenna resonating element support member (as examples).

Antenna resonating elements 66 may be formed using conductive structures such as patterned metal foil or metal traces on a dielectric substrate. Metal traces may be patterned using selective laser surface activation followed by electroplating (sometimes referred to as laser direct structuring), by blanket metal deposition using physical vapor deposition equipment or electrochemical deposition followed by photolithographic patterning, by screen printing, etc. The conductive structures of antenna structures 66 may be supported by glass ceramic carriers, plastic carriers, printed circuits, or other dielectric support structures such as dielectric support structures 84. Conductive materials for antenna resonating elements 66 may, for example, be supported on dielectric supports 84 such as injection-molded plastic carriers, glass or ceramic members, or other insulators.

In a configuration in which antenna resonating elements are formed from metal traces on dielectric support structure 84 and in which antenna ground 64 is formed from a stamped sheet metal structure, solder may be used in forming electrical connections 86 between antenna resonating elements 66 and antenna ground.

Figure 8:
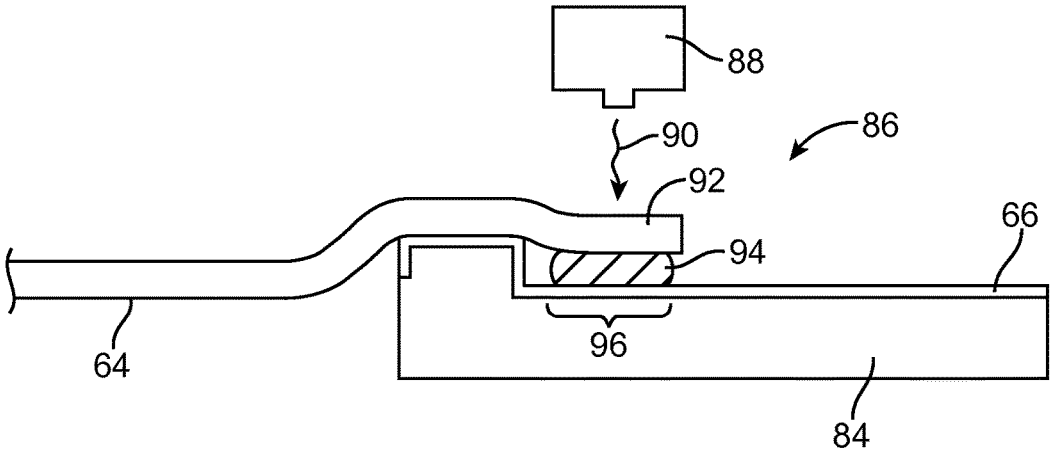
FIG. 8 is a cross-sectional side view of structures such as antenna structures being soldered together using laser heating of a metal structure in accordance with an embodiment of the present invention.

Metal traces are typically relatively thin (e.g., less than 100 microns thick, less than 10 microns thick, or less than 1 micron thick). To avoid damaging metal traces on a dielectric carrier during soldering operations, it may be desirable to apply heat to a solder joint indirectly. For example, solder paste at a joint associated with electrical connections 86 may be heated by heating sheet metal structures or other structures that are thicker than metal traces. As shown in FIG. 8, for example, laser 88 may be used to generate laser light 90 that is applied to portion 92 of a metal structure such as a sheet metal structure forming antenna ground 64 (e.g., a metal member that is thicker than conductive trace 66 on dielectric support structure 84).

Solder joint 94 of FIG. 8 may be used in forming electrical connection 86 between antenna resonating element 66 (or other conductive structures) and antenna ground 64 (or other conductive structures). Antenna resonating element 66 is formed from a metal trace on the surface of dielectric support structures 84. Initially, a layer of solder paste may be interposed between portion 92 of metal antenna ground structure 64 and portion 96 of the trace forming antenna resonating element 66 on dielectric support structure 84. The layer of solder paste may be converted into a solder joint by applying heat to portion 92 and thereby reflowing the solder paste.

To avoid damage to sensitive structures such as the thin layer of metal forming portion 96 of the metal trace of antenna resonating element 66, laser 88 may be used to apply light 90 directly to portion 92 of metal antenna ground 64, rather than to the solder paste, the trace forming antenna resonating element 66, or potentially sensitive dielectric support structure 84.

Laser light 90 may have any suitable wavelength. For example, laser 88 may be an infrared laser such as a $CO_2$ laser and laser light 90 may be infrared light to minimize reflections from the metal of portion 92 of antenna ground 64. When laser light 90 from laser 88 is applied to portion 92 of a metal structure such as a metal sheet or other metal part forming antenna ground 64, portion 92 will rise in temperature. The heat from portion 92 will be thermally conducted to the solder paste under portion 92, thereby reflowing the solder paste to form solder 94 for electrical connection 86 between antenna ground 64 and antenna resonating element 66.

If desired, an additional piece of metal may be placed against the solder paste to serve as a heating element for the solder paste. This type of configuration is shown in the cross-sectional side view of FIG. 9. In the FIG. 9 example, electrical connection 86 is being formed between respective metal traces 102 and 104. Metal trace 102 may be a patterned trace formed on a dielectric carrier such as dielectric support structures 100. Metal trace 104 may be a patterned trace formed on a dielectric carrier such as dielectric support structures 106. Dielectric support structures 100 and 106 may be plastic such as injection molded plastic or other dielectric such as glass, ceramic, etc. Metal traces 102 and 104 may be used to form antenna structures 44 or other conductive structures. Metal member 108 may be a strip of metal, a circular or oval rod of metal, other elongated metal members, or metal structures having other suitable shapes. The thickness of metal member 108 is preferably greater than the thickness of metal traces 102 and 104.

Metal member 108 is separate from metal traces 102 and 104 and is preferably embedded fully or partially within solder paste for forming solder joint 94. When it is desired to reflow the solder paste to form a solder joint between metal traces 102 and 104 and thereby form electrical connection 86 between traces 102 and 104, laser 88 may apply light such as infrared laser light 90 directly to metal member 108. Laser light 90 need not strike adjacent structures metal traces 102 and 104. Metal member 108 may absorb the infrared light that is applied, causing the temperature of metal member 108 to rise and heat the adjacent solder paste to form solder joint 94.

Figure 9:
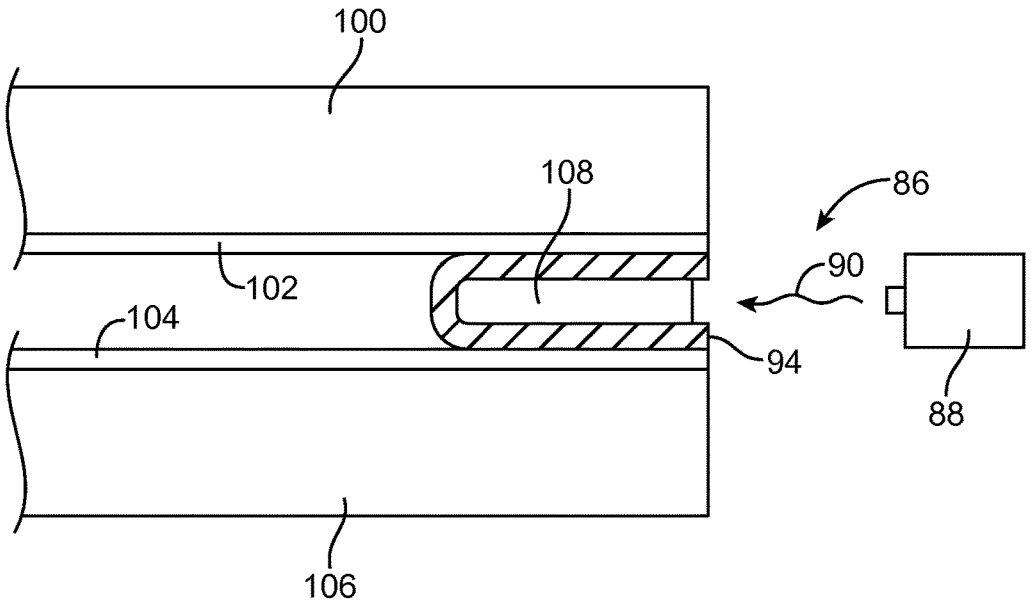
FIG. 9 is a cross-sectional side view of structures such as antenna structures having metal traces on plastic carriers being soldered together by applying laser light to a metal member embedded within solder paste in accordance with an embodiment of the present invention.

If desired, other types of parts may be joined using separate metal members such as illustrative member 108 of FIG. 9. For example, a pair of metal parts may be joined using a separate metal member such as metal member 108. The metal structures that are being joined may be antenna resonating elements 66, antenna ground structures 64, or other conductive components.

Figure 10:
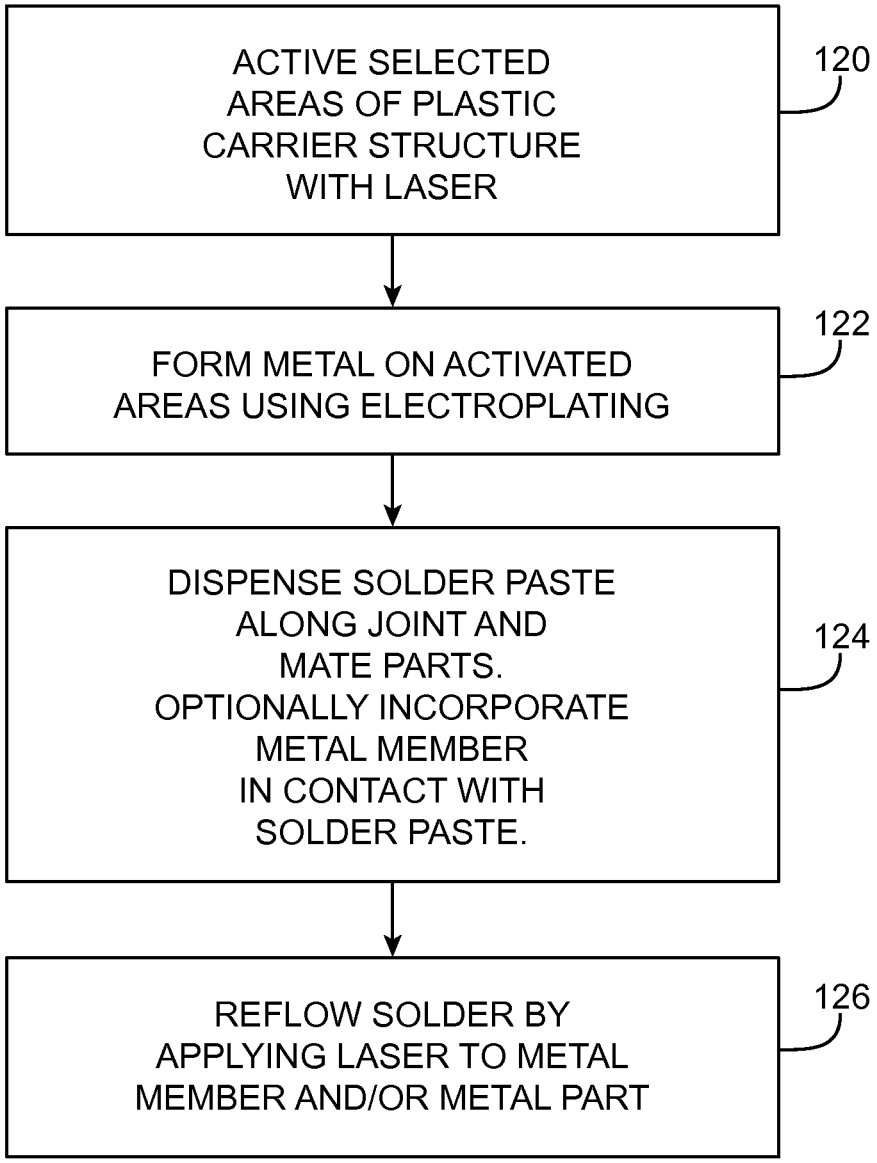
FIG. 10 is a flow chart of illustrative steps involved in forming structures such as antenna structures with solder joints by applying laser light to metal structures at the joints in accordance with an embodiment of the present invention.

Illustrative steps involved in forming electrical connections 86 are shown in FIG. 10. Initially, metal traces may be patterned onto dielectric support structures. For example, laser light may be applied to selected portions of the surface of a plastic carrier (e.g., a plastic carrier containing metal particles). The laser light is applied at step 120, which activates the illuminated areas without activating the unilluminated areas. Metal plating techniques (step 122) may then be used to form metal traces on the dielectric support structures (e.g., traces for forming antenna resonating elements 66 or other structures on substrates such as dielectric support structures 84). The process of using laser light activation (step 120) and subsequent electroplating (step 122) to form patterned metal traces on the dielectric support structure is merely illustrative. Any suitable technique for forming patterned metal traces on a plastic carrier or other dielectric structure may be used if desired.

Following formation of patterned metal traces and formation of any additional parts to be joined with a solder joint (e.g., following metal stamping or other techniques to form a stamped metal sheet for antenna ground structures 64), a needle-based application tool, screen printing equipment, or other equipment may be used to dispense solder paste onto the structures to be joined. Solder paste may be applied along appropriate portions of the edge of antenna ground structures 64 or other sheet metal structure and/or may be applied along corresponding mating edge portions of dielectric support structures 84 (e.g., after antenna resonating element traces have been formed on the surface of dielectric support structures 84). In scenarios of the type shown in FIG. 9 in which metal traces on two plastic parts are being joined, one or more elongated metal members may be incorporated into the solder paste.

At step 126, after the joint in the parts to be joined has been provided with solder paste and has been provided with the optional elongated metal member, laser light such as infrared laser light may be applied to the metal structures at the joint. For example, the laser light may be applied to a portion of the metal of the part being joined such as portion 92 of metal antenna ground 64 of FIG. 8 and/or may be applied to the separate elongated metal strip in the solder paste such as metal member 108 of FIG. 9). The applied laser light heats the metal and reflows the solder that is adjacent to the metal. The molten solder forms a solder joint between the metal traces on the dielectric carrier and the metal traces on another dielectric carrier (see, e.g., FIG. 8) or forms a solder joint between the metal traces on the dielectric carrier and a corresponding portion of a metal structure (see, e.g., metal antenna ground structure 64 of FIG. 9).

Figure 11:
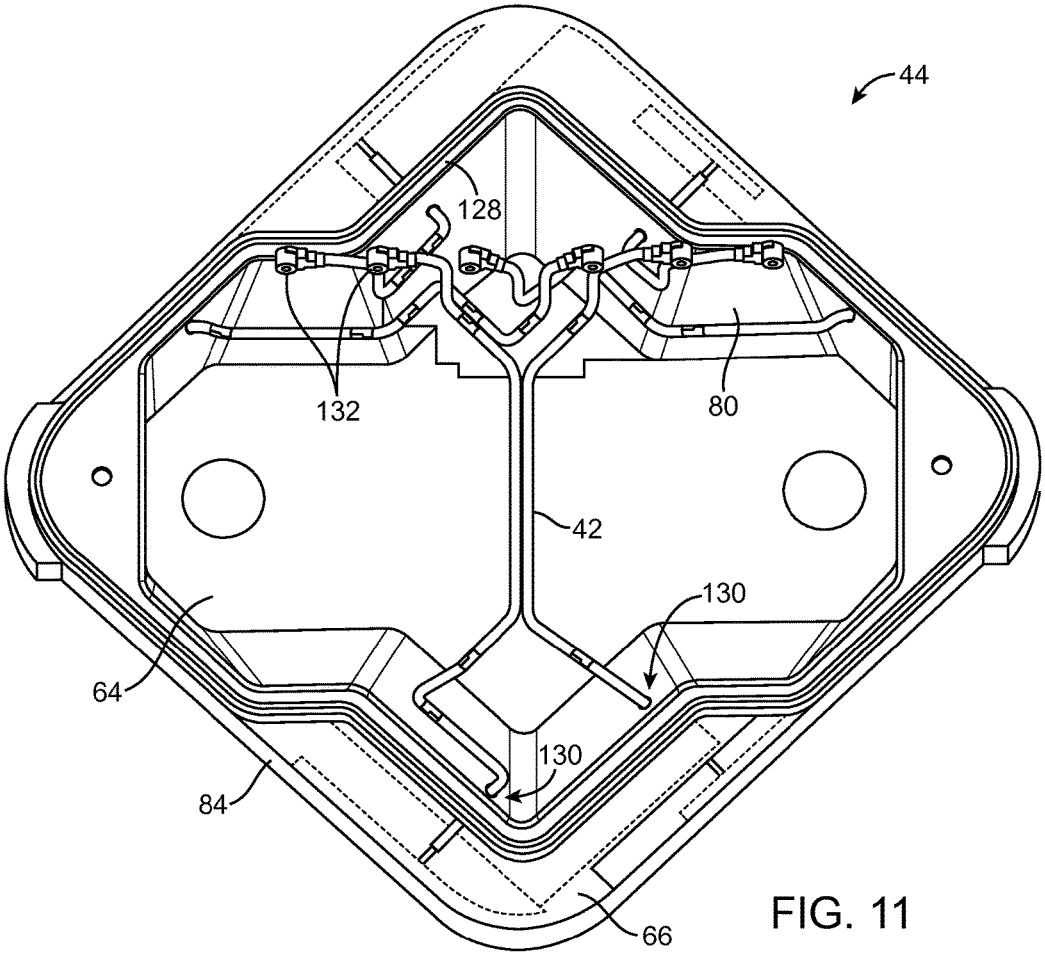
FIG. 11 is a bottom perspective view of an illustrative stamped metal antenna can of the type that may be used in forming antenna ground structures for the electronic device of FIG. 1 in accordance with an embodiment of the present invention.

FIG. 11 is a bottom perspective view of illustrative antenna structures 44 using a process of the type shown in FIG. 10. In the orientation of FIG. 11, the antenna resonating element structures 66 are formed on the far side of dielectric support structures 84. Dielectric support structures 84 surround peripheral edge of antenna ground structures 64. As described in connection with FIG. 6, antenna ground structures 64 may be formed from a stamped sheet of metal having slanted steps such as slanted (angled) surface 80. Openings 130 may be formed to allow coaxial cables 42 to penetrate from one side of antenna ground structures 64 to the other. When assembled into device 10, connectors 132 at the end of each coaxial cable mate with corresponding printed circuit board connectors in transceiver circuitry 40.

The foregoing is merely illustrative of the principles of this invention and various modifications can be made by those skilled in the art without departing from the scope and spirit of the invention. The foregoing embodiments may be implemented individually or in any combination.

What is claimed is:

1. Apparatus, comprising:

a layer of metal that forms an antenna ground;

antenna resonating element traces supported by a dielectric, wherein each of the antenna resonating element traces and the antenna ground form a respective antenna in an array of antennas;

and solder that connects the antenna resonating element traces to the antenna ground, wherein the array of antennas comprises six antennas, at least some of the antennas have different electric field polarizations, at least three of the antennas are configured to transmit and receive radio-frequency signals in at least a 5 GHz communications band, and at least three of the antennas are configured to transmit and receive radio-frequency signals in at least a 2.4 GHz communications band.

2. The apparatus defined in claim 1 wherein the layer of metal that forms the antenna ground comprises sheet metal.

3. The apparatus defined in claim 2 wherein the dielectric comprises a plastic carrier.

4. Apparatus, comprising:

sheet metal that forms an antenna ground;

a ring shaped plastic carrier that surrounds the sheet metal and that has antenna resonating element traces, wherein each of the antenna resonating element traces and the antenna ground form a respective antenna in an array of antennas; and solder that connects the antenna resonating element traces to the sheet metal that forms the antenna ground.

5. The apparatus defined in claim 4 wherein the array of antennas comprises six antennas.

6. The apparatus defined in claim 5 wherein at least some of the antennas have different electric field polarizations.

7. The apparatus defined in claim 6 wherein at least three of the antennas are configured to transmit and receive radio-frequency signals in at least a 5 GHz communications band and wherein at least three of the antennas are configured to transmit and receive radio-frequency signals in at least a 2.4 GHz communications band.

8. The apparatus defined in claim 5 further comprising:

radio-frequency transceiver circuitry coupled to the array of antennas; and storage and processing circuitry coupled to the radio-frequency transceiver circuitry.

9. The apparatus defined in claim 8 wherein the storage and processing circuitry and the radio-frequency transceiver circuitry are configured to perform wireless base station operations and the storage and processing circuitry includes a mass storage device having a capacity of at least 256 GB.

10. The apparatus defined in claim 2, wherein the sheet metal comprises stamped sheet metal.

11. The apparatus defined in claim 10, wherein the stamped sheet metal has a planar portion, a first slanted portion that is bent at a non-zero angle with respect to the planar portion, a second slanted portion that is bent at a non-zero angle with respect to the planar portion, and the planar portion is interposed between the first and second slanted portions.

12. Apparatus, comprising:

stamped sheet metal that forms an antenna ground;

dielectric support structures having antenna resonating element traces, wherein each antenna resonating element trace and the antenna ground form a respective antenna in an array of antennas;

solder that connects the antenna resonating element traces to the stamped sheet metal that forms the antenna ground, wherein the stamped sheet metal has a planar portion, a first slanted portion that is bent at a non-zero angle with respect to the planar portion, and a second slanted portion that is bent at a non-zero angle with respect to the planar portion, and the planar portion is interposed between the first and second slanted portions; and a conductive bracket, wherein the planar portion is mounted to the conductive bracket and is electrically shorted to the conductive bracket.

13. The apparatus defined in claim 12, further comprising:

storage circuitry mounted within the conductive bracket and below the planar portion of the stamped sheet metal.

14. The apparatus defined in claim 12, the stamped sheet metal further comprising:

an additional planar portion, wherein the first and second slanted portions are both interposed between the planar portion and the additional planar portion, and the dielectric support structures completely surround the additional planar portion.

15. The apparatus defined in claim 14, further comprising:

housing structures, wherein the stamped sheet metal, the dielectric support structures, the conductive bracket, and the solder are each enclosed within the housing structures.

16. The apparatus defined in claim 15, wherein the housing structures comprise a wall structure, the planar portion and the additional planar portion of the stamped sheet metal each extend parallel to the wall structure, the planar portion is formed at a first distance from the wall structure, and the additional planar portion is formed at a second distance from the wall structure that is greater than the first distance.

17. The apparatus defined in claim 11, further comprising:

radio-frequency transceiver circuitry; and a plurality of coaxial cables each having a corresponding radio-frequency connector structure that is coupled to the radio-frequency transceiver circuitry.

18. The apparatus defined in claim 17, wherein the first and second portions of the stamped sheet metal comprise a plurality of openings through which the plurality of coaxial cables pass, wherein each coaxial cable of the plurality of coaxial cables is coupled to a respective antenna resonating element trace in the array of antennas through a respective opening of the plurality of openings.

19. The apparatus defined in claim 11, wherein the antenna resonating element traces comprise first, second, third, and fourth antenna resonating element traces, the first and second resonating element traces each extend in a first direction, and the third and fourth resonating element traces each extend in a second direction that is perpendicular to the first direction.

20. The apparatus defined in claim 19, wherein the stamped sheet metal has first, second, third, and fourth peripheral edges, the first and second peripheral edges extend between and perpendicular to the third and fourth peripheral edges, the solder connects the first antenna resonating element trace to the third peripheral edge, the solder connects the second antenna resonating element trace to the fourth peripheral edge, the solder connects the third antenna resonating element trace to the first peripheral edge, the solder connects the fourth antenna resonating element trace to the second peripheral edge, the second antenna resonating element trace is configured to resonate in a first radio-frequency communications band, and the fourth antenna resonating element trace is configured to resonate in a second radio-frequency communications band that is different from the first radio-frequency communications band.

* * * * *